US008186678B1

(12) United States Patent
Acquaviva

(10) Patent No.: US 8,186,678 B1
(45) Date of Patent: May 29, 2012

(54) SPIN BOX

(76) Inventor: David Paul Acquaviva, Fresno, CA (US)

( * ) Notice: Subject to any disclaimer, the term of this patent is extended or adjusted under 35 U.S.C. 154(b) by 167 days.

(21) Appl. No.: 12/802,689

(22) Filed: Jun. 11, 2010

(51) Int. Cl.
*A63F 7/00* (2006.01)
*A63F 9/26* (2006.01)

(52) U.S. Cl. ..... 273/110; 273/449; 273/109

(58) Field of Classification Search ..... 273/108–110, 273/112, 441, 153 R, 153 S
See application file for complete search history.

(56) References Cited

U.S. PATENT DOCUMENTS

| | | | | | |
|---|---|---|---|---|---|
| 432,483 | A | * | 7/1890 | Fitler | 273/112 |
| 435,790 | A | | 9/1890 | Bolls | |
| 1,150,761 | A | | 8/1915 | Hartman | |
| 1,500,869 | A | | 7/1924 | Hinson | |
| 3,005,635 | A | * | 10/1961 | Greene | 273/109 |
| 3,118,676 | A | * | 1/1964 | Louis | 273/109 |
| 3,384,374 | A | * | 5/1968 | Boothe | 273/110 |
| 3,416,801 | A | * | 12/1968 | McKeown | 273/110 |
| 4,065,132 | A | * | 12/1977 | Giakas | 273/153 R |
| 4,118,031 | A | * | 10/1978 | Westbrook | 273/110 |
| 4,143,875 | A | * | 3/1979 | Browning et al. | 273/355 |
| 4,357,016 | A | * | 11/1982 | Allison | 273/156 |
| 4,557,701 | A | * | 12/1985 | Giallombardo | 446/170 |
| 4,887,814 | A | * | 12/1989 | Winter | 473/596 |
| D311,033 | S | * | 10/1990 | Yokoyama | D21/311 |
| 5,066,014 | A | * | 11/1991 | Dobson | 273/110 |
| 5,421,575 | A | * | 6/1995 | Triner | 273/109 |
| 5,441,260 | A | * | 8/1995 | Gogarty | 273/153 R |
| 7,367,565 | B2 | * | 5/2008 | Chiu | 273/449 |
| 2003/0015839 | A1 | * | 1/2003 | Ignatiev | 273/153 R |
| 2004/0046318 | A1 | * | 3/2004 | Christensen | 273/153 S |

* cited by examiner

*Primary Examiner* — Raleigh W. Chiu

(57) ABSTRACT

A device for developing hand-eye coordination of the type having a drum (90) with a furrow (92) meandering around drum (90) with drum pin (94A and 94B) mated to slot (120A and 120B) of hoop (116). Marble (10) is negotiated over furrow (92) by turning drum pin (94A and 94B) with each hand while simultaneously using drum pin (94A and 94B) to roll hoop (116) to complete the length of furrow (92).

17 Claims, 14 Drawing Sheets

SPIN BOX

FEDERALLY SPONSORED RESEARCH

Not Applicable

SEQUENCE LISTING OR PROGRAM

Not Applicable

BACKGROUND OF INVENTION

1. Field of Invention

This invention relates to games of skill to balance a ball through a course with pitfalls requiring dexterity and hand-eye coordination to maneuver a ball to complete the course.

2. Prior Art

There are various devices that have been developed for the purpose of amusement that require players to acquire a skill in order to become proficient at playing the game. Specifically, games that require a player to balance a ball through a course maze with pitfalls that make the game challenging and interesting.

U.S. Pat. No. 435,790 Boils (1890) introduces a toy that shows a cylindrical tube with a spiral groove lengthwise with a ball. Bolls teaches that his device is to be held with two hands at each end of the cylinder. This is so a person can manipulate the slope to cause the ball to run down hill. The spiral requires a person to turn the cylinder while pitching to keep the ball in the groove. Bolls teaches that his device has an imaginary axis with an infinite amount of positions for a person to pitch and roll the cylinder. Bolls does not teach or suggest that his device be modified to constrain the roll of the cylinder's imaginary axis by utilizing an axle nor does he suggest that his device utilize a compound axis hardware system to control the pitch and roll at the same time with parameters.

U.S. Pat. No. 1,150,761 Hartman (1915) introduces a ball with a spiral groove on the outside and a marble that fits inside the groove. The object of this device is to roll the ball in the groove by controlling the pitch of the cylindrical pin causing the marble to run down hill. Hartman teaches that his device has an imaginary axis with an infinite number of positions. Hartman does not teach or suggest that his device constrain the imaginary axis utilizing hardware to control the parameters.

U.S. Pat. No. 1,500,869 Hinson (1923) shows a triangular bar with a continuous groove traversing the length on the outside with a transparent material covering the groove so as to trap small differing color balls inside the groove as it turns on its axis. Hinson shows that at each end of the triangular bar are pins that allow a person to spin the unit to cause the small balls to run down the groove. Hinson teaches that the object of her device is amusement through participation as a person spins the device the color balls move alone the groove. Hinson teaches that little skill is required to operate her device. Hinson does not teach or suggest that a compound axis hardware system is required or necessary to operate her device. Since multiple balls are in the groove at the same time and the transparent cover keeps them in the groove, balance is not required to move the balls along the groove.

The prior art heretofore known demonstrates many examples of amusement devices that attempt to enhance balancing skill through entertainment. Nevertheless, all of the devices known suffer from a number of disadvantages:

(a) Infinite imaginary axis without constraints does not allow for hand-eye coordination skills utilizing both hands in a resting tandem position. Infinite imaginary axis has the disadvantage of infinite variables without parameters. This makes learning difficult and less uniform amongst different players.

(b) Without constrained two axis hardware system the maze or coarse that a marble follows is necessarily simple and predictable. This leads to boredom of the toy after limited play.

(c) Lack of supporting structure causes stress and fatigue for players resulting in frustration. Without supporting structure a player must utilizing their whole body during manipulation. Players need to stand or sway their body with the device as it moves.

OBJECTS AND ADVANTAGES

Several objects and advantages of the present invention are:

(a) To provide a non planar surface or cylindrical toy with a compound two axis hardware system that allows precise movement within constrained parameters. Constrained parameters set forth the rules of the game for players to accomplish.

(b) To provide a cylindrical toy with an exciting intricate course groove with lots of turns of varying degrees of difficulty to keep players motivated and fulfilled during play. Having an irregular maze with differing curves of complexity allows players to reach milestones throughout the maze. Each new curve represents a new challenge a player must overcome. This allows differing players to show off their skill and competence. This exciting irregular maze enhances competition and entertainment for spectators.

(c) To provide a cylindrical toy with supporting structure that allows a player to relax and let the game rest on a surface with the toy movement supported on a bearing hardware system. This allows a player to spin the cylindrical toy on the bearings effortlessly reducing friction and ease of movement. Supporting structure allows precise control with minimal physical effort yet a high degree of mental challenge.

Further objects and advantages are to provide a cylindrical toy with interchangeable spindles so as to keep the game challenging and interesting as each new maze is mastered, to provide different levels of overall course skill requirements to accommodate players of ages ranging for six to 99, to provide a cylindrical toy that is aesthetically pleasing to look at and display as an ornament when not in use, to provide a cylindrical toy that is a unique pleasuring experience. Still further objects and advantages will become apparent from a consideration of the ensuing description and drawings.

SUMMARY

In accordance with the present invention an amusement toy comprises a cylindrical body with a tangent irregular groove meandering the length and circumference of the cylindrical body, with a reduced integral portion or reduced cylindrical portion at each end, a bearing surface mated to each end of the reduced cylindrical portions to control the roll of the cylindrical body, and a semi annular surface to control the pitch of the cylindrical body.

DRAWINGS

Figures

Figure 5:
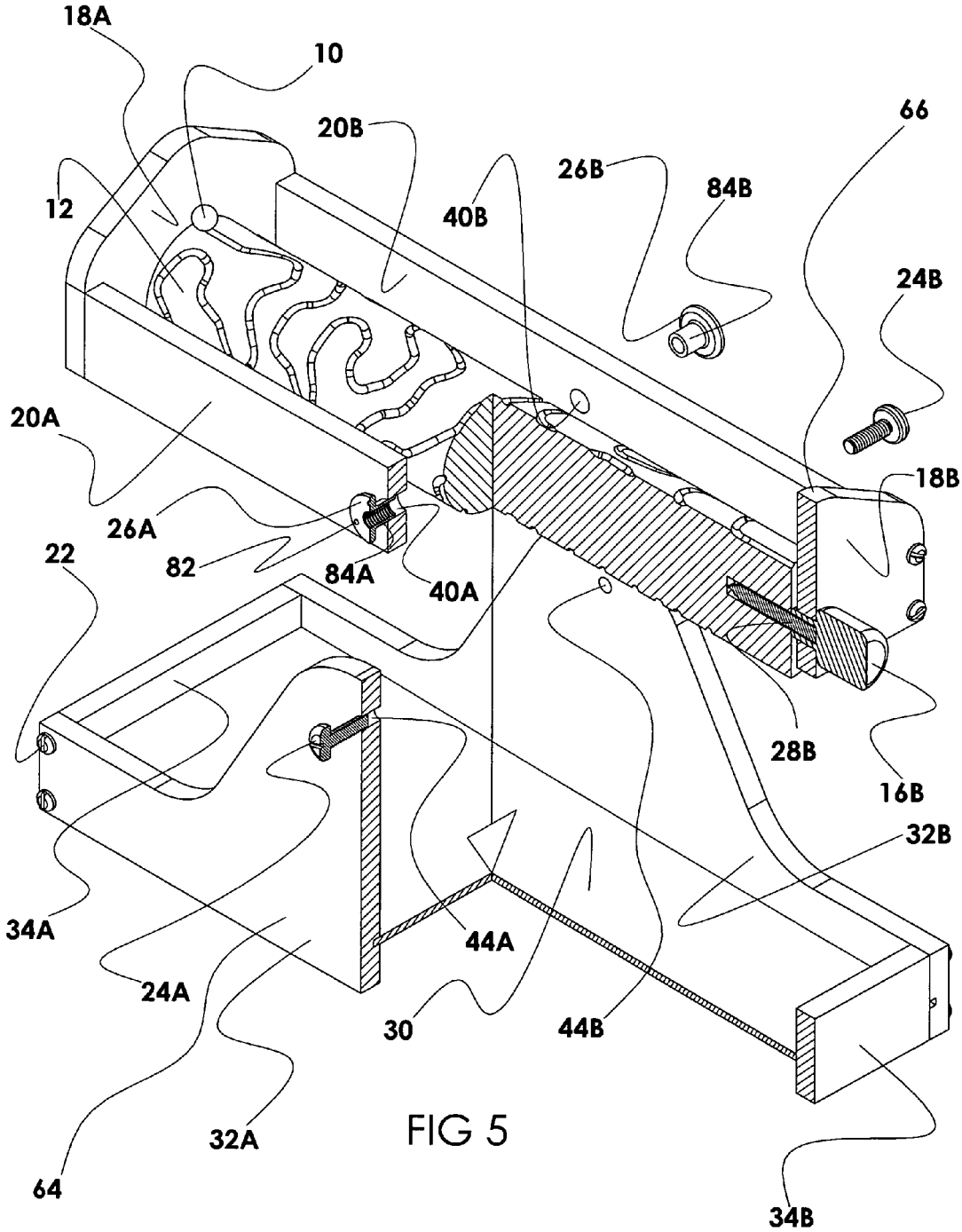
Figure 6:
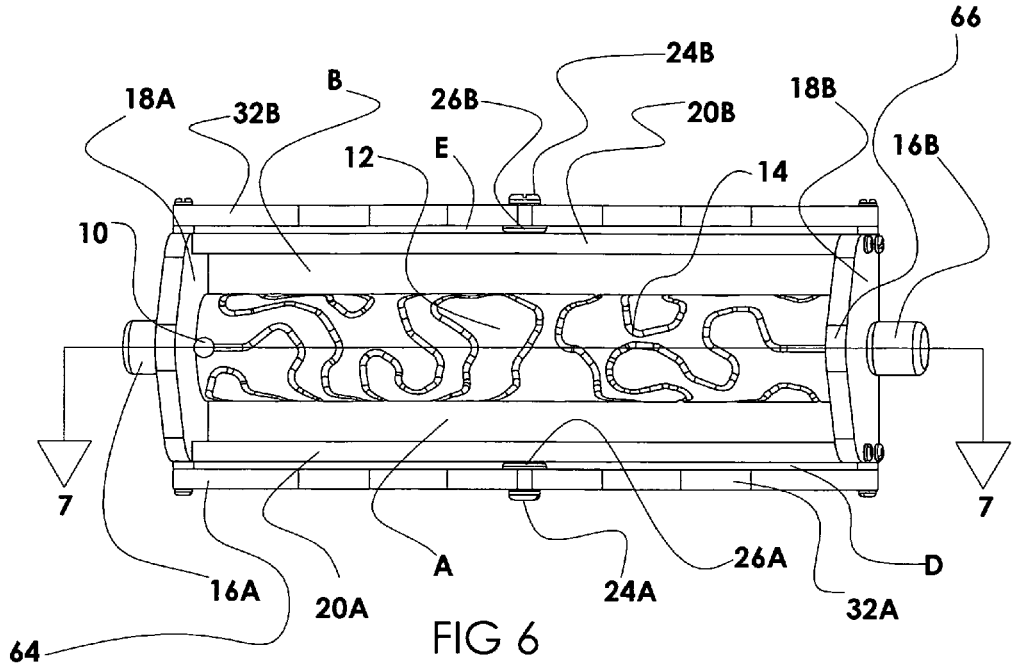

FIG. 5 shows a perspective view of teeter box 64 and pin box 66 with cross section FIG. 6 shows a top view of the first embodiment with cross section line 7-7

Figure 7:
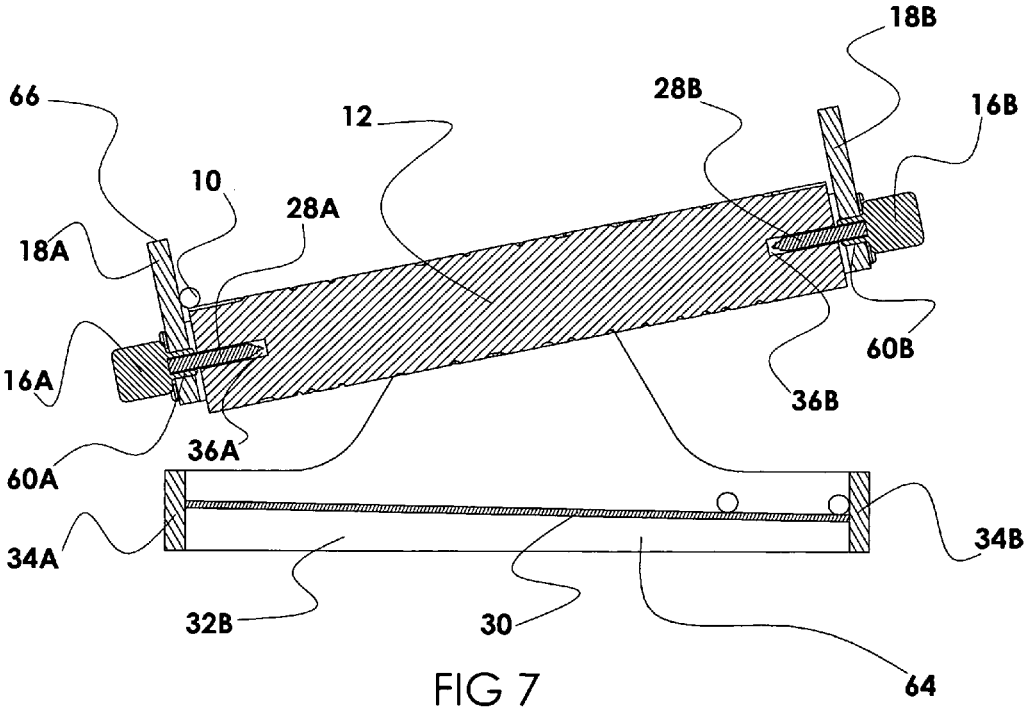

FIG. 7 shows a front view cross section of the first embodiment

Figure 8:
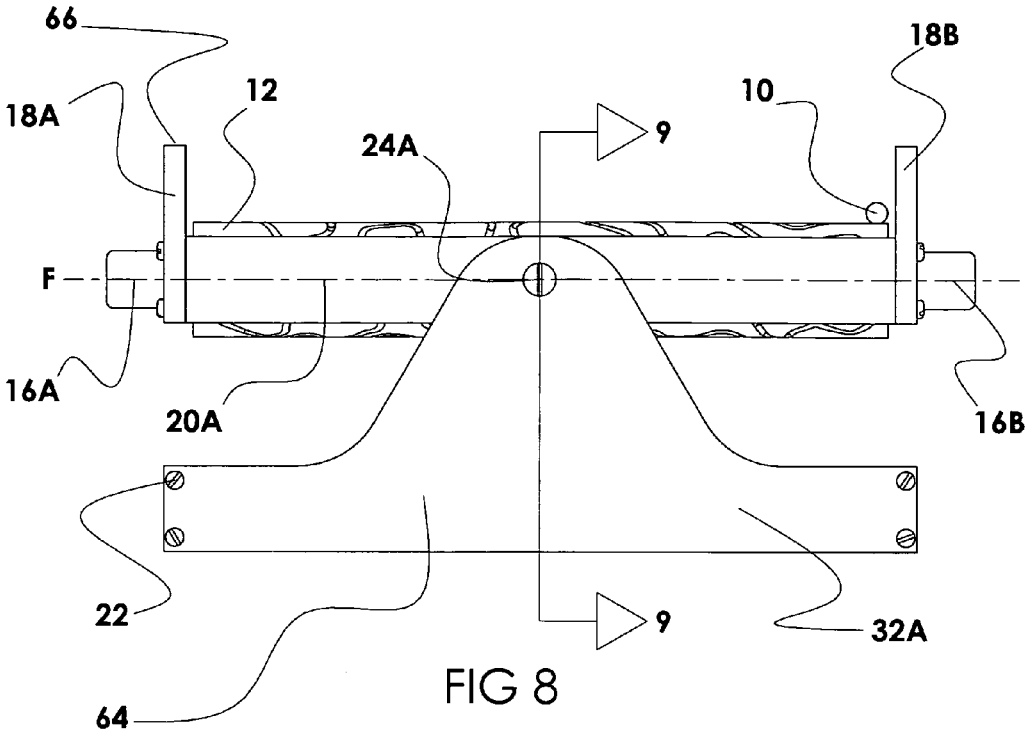

FIG. 8 shows a front view of the first embodiment with plane F and cross section line 9-9

Figure 9:
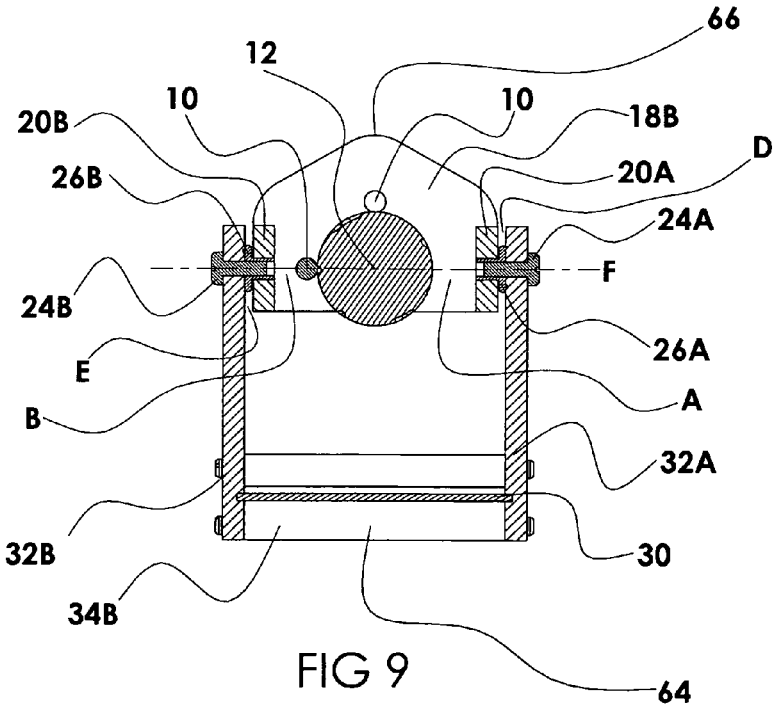
Figure 10:
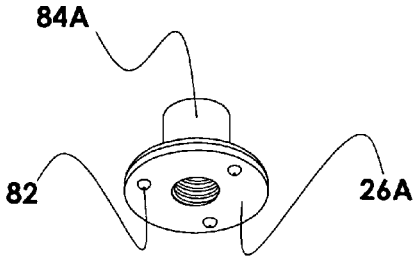

FIG. 9 shows a right view cross section of the first embodiment with plane F FIG. 10 shows a perspective view of teeter pin 84A with spin lock 82

Figure 11:
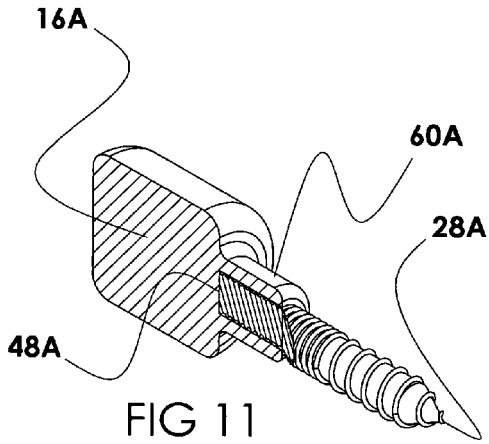

FIG. 11 shows a perspective view of knob 16A with exposed cross section

Figure 12:
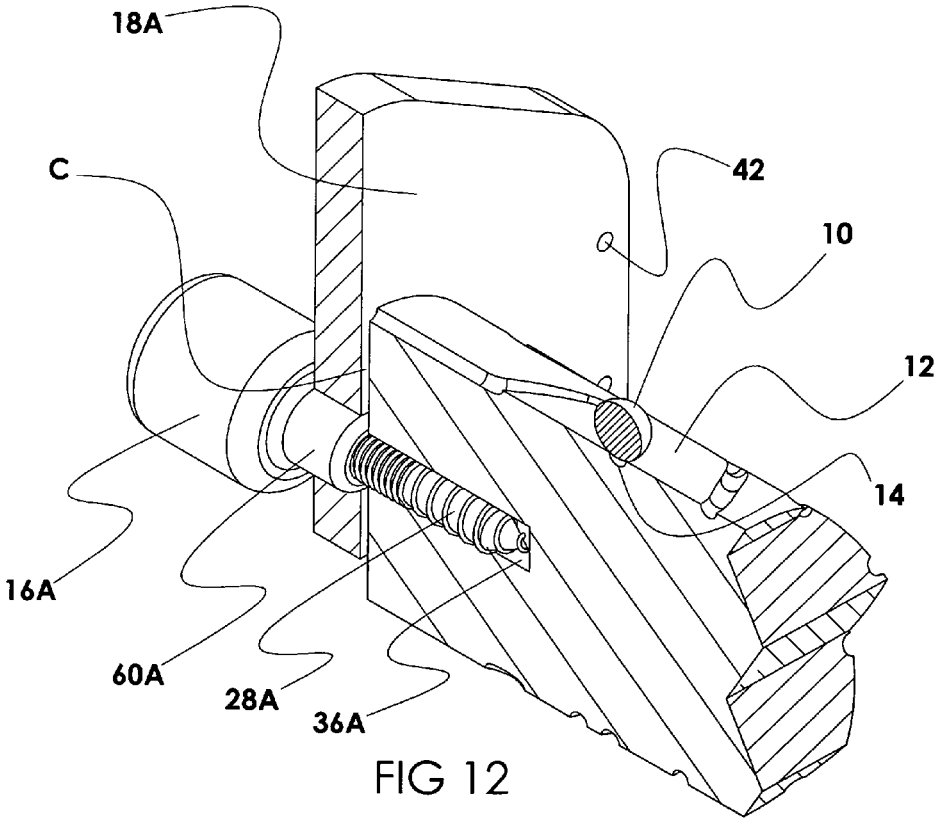
Figure 13:
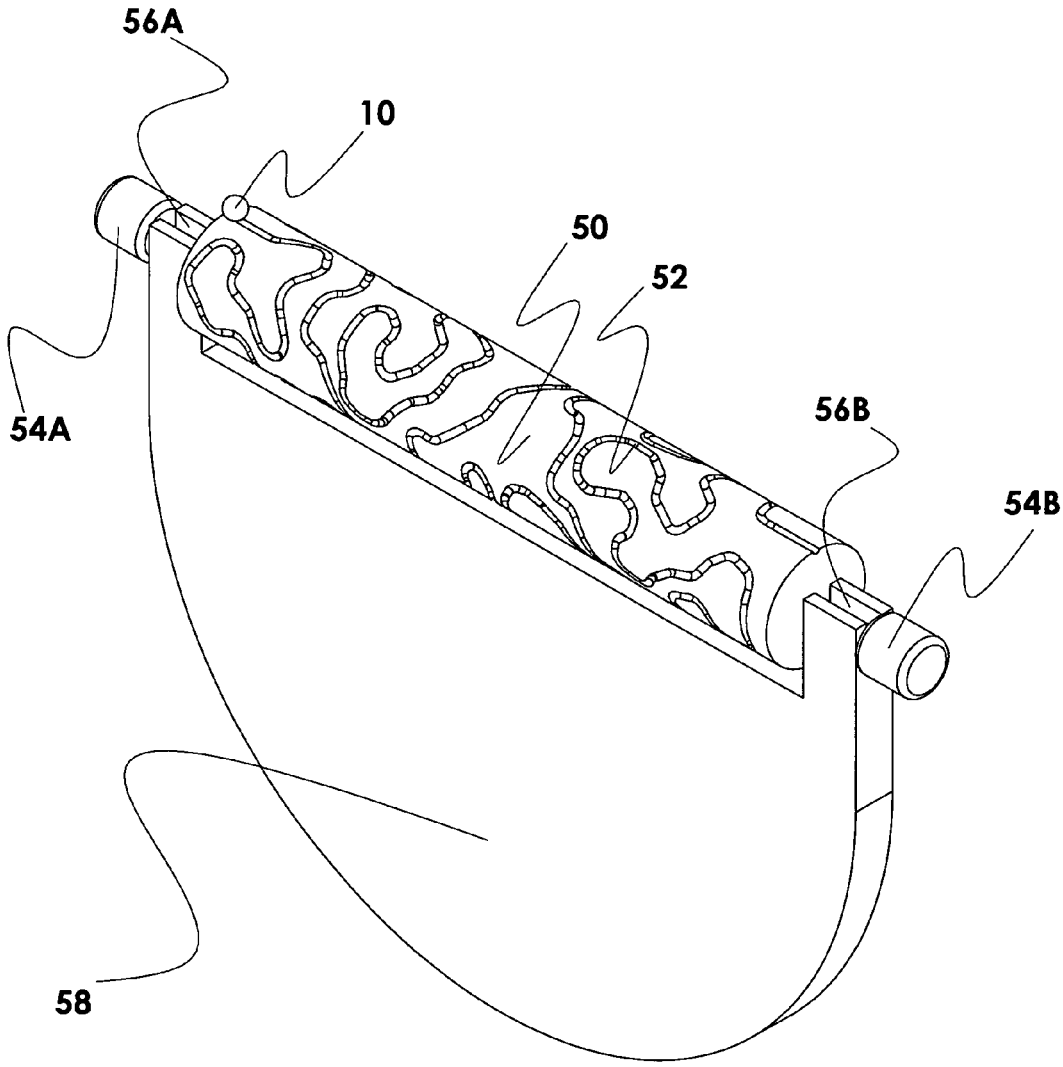
Figure 14:
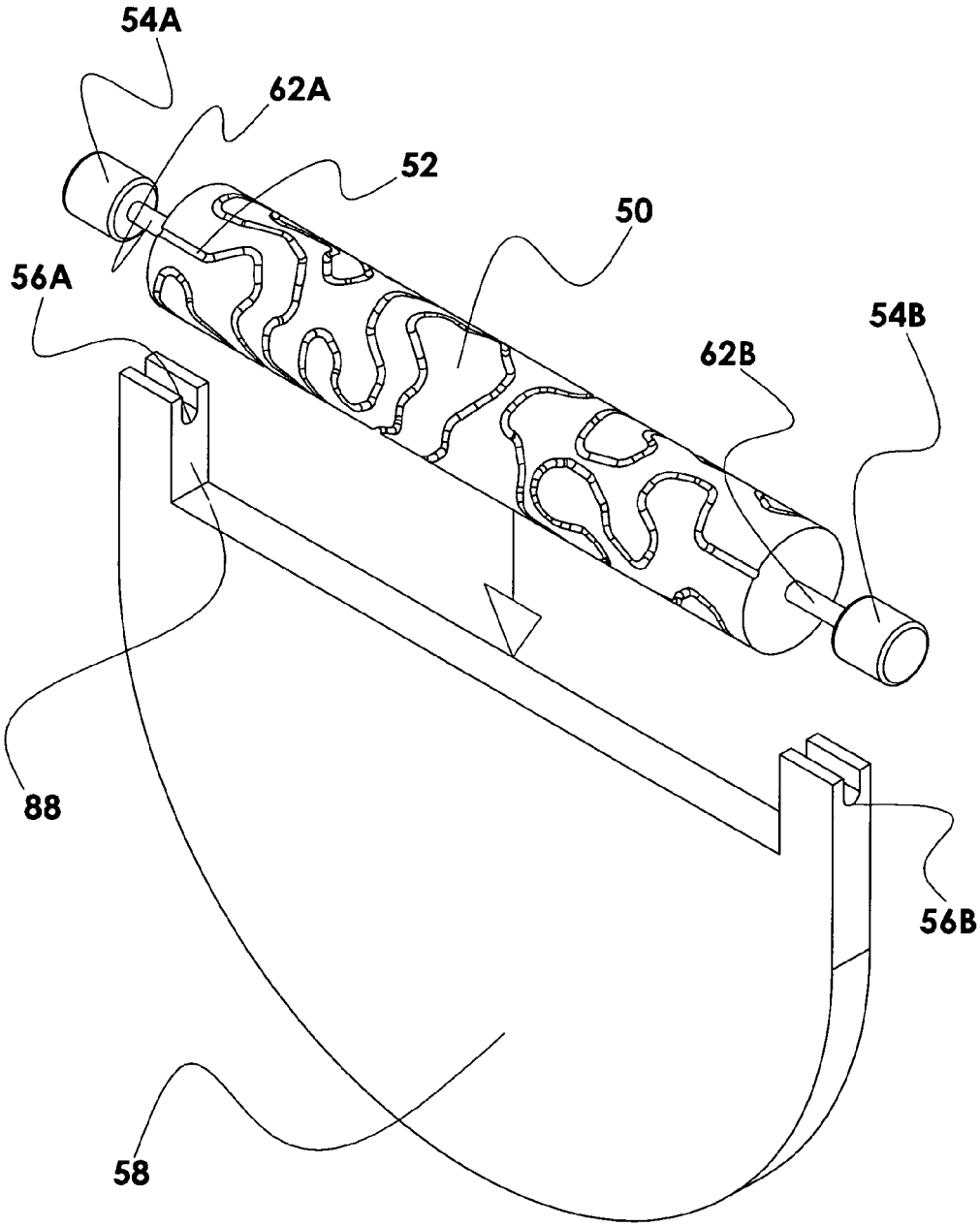
Figure 15:
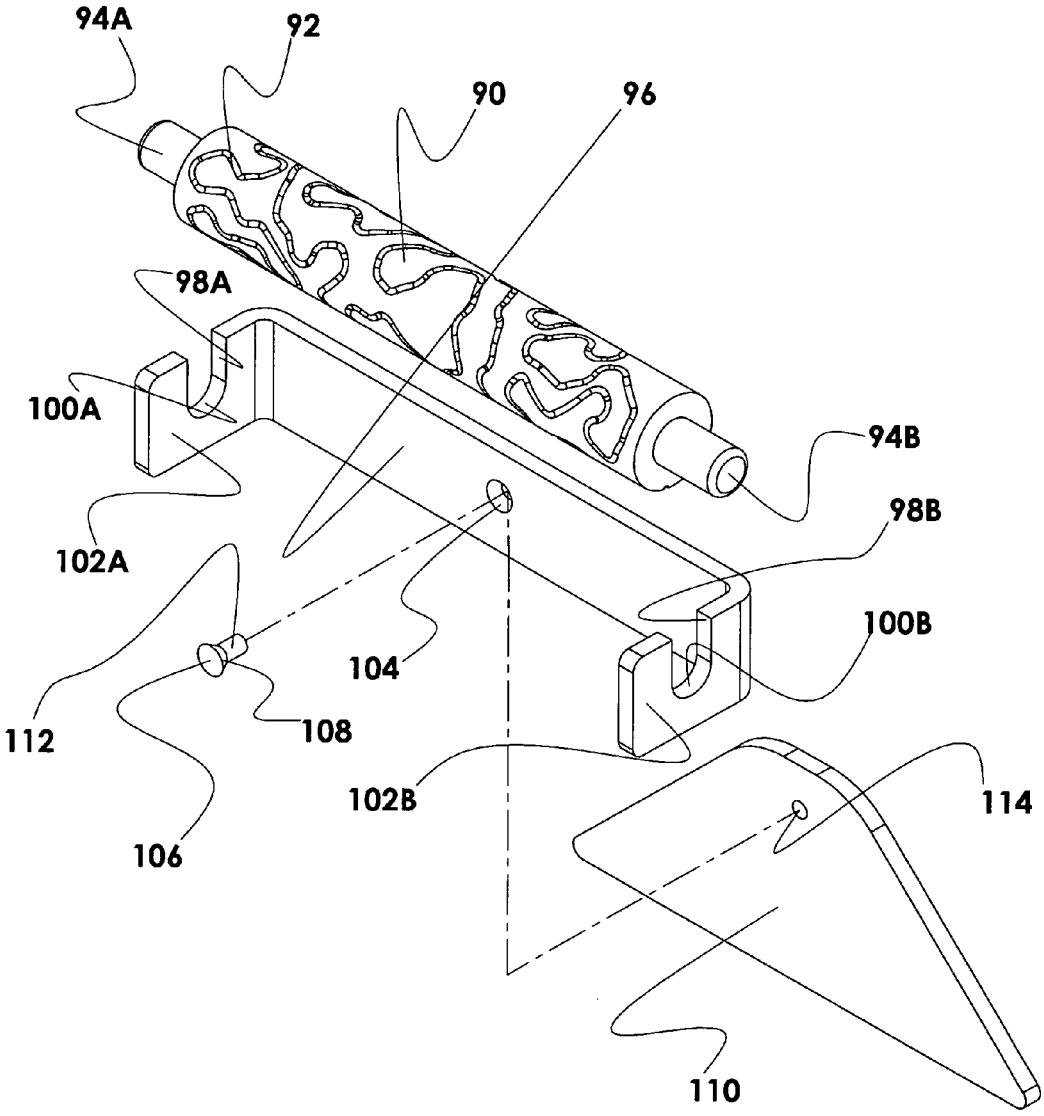
Figure 16:
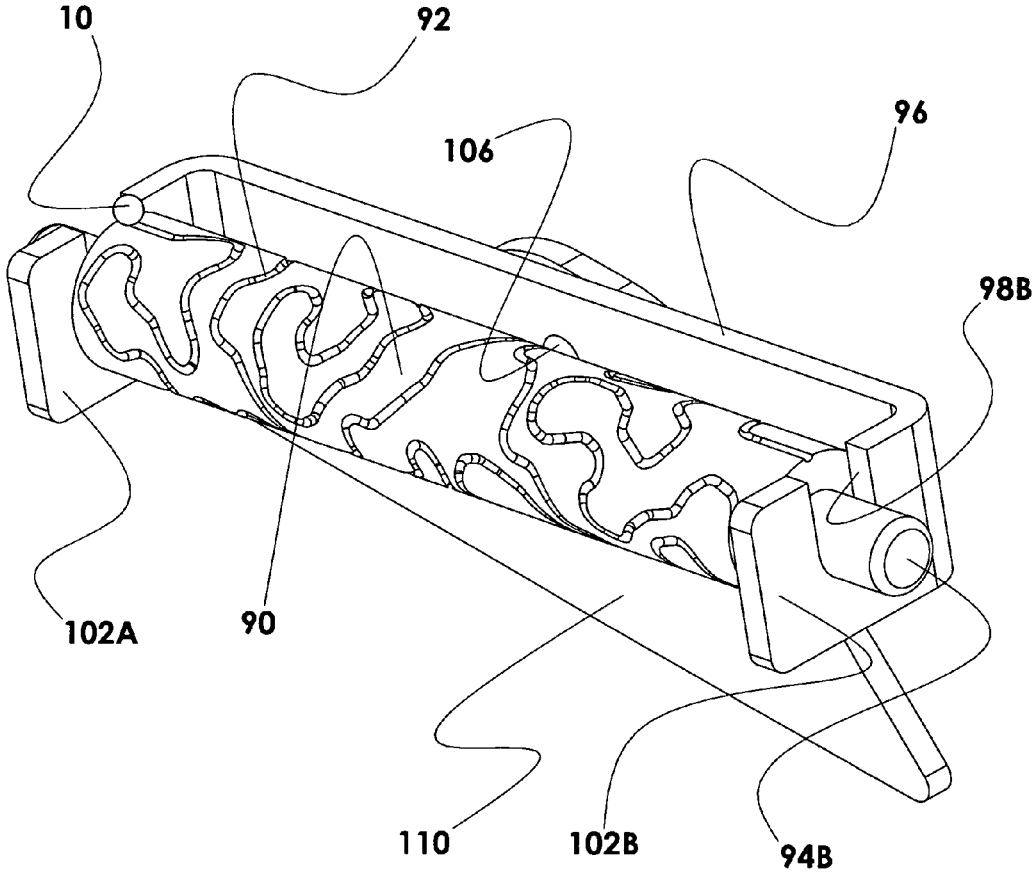

FIG. 12 shows a perspective view of knob 16A assembled to cross section elements FIG. 13 shows a perspective view of an alternate embodiment FIG. 14 shows a perspective view of an alternate embodiment with exploded elements FIG. 15 shows a perspective view of additional embodiment with exploded elements FIG. 16 show a perspective view of additional embodiment with tri bar 96

Figure 17:
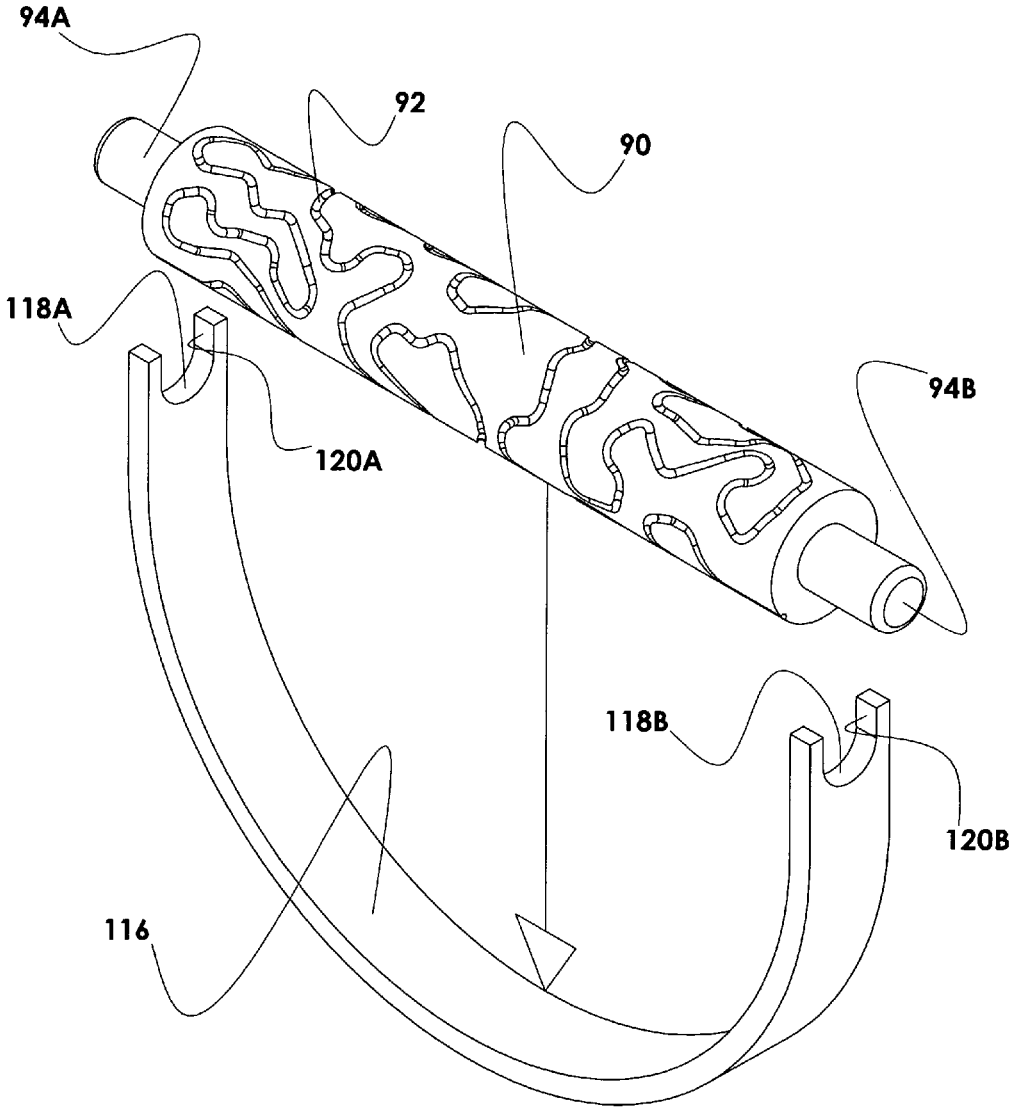
Figure 18:
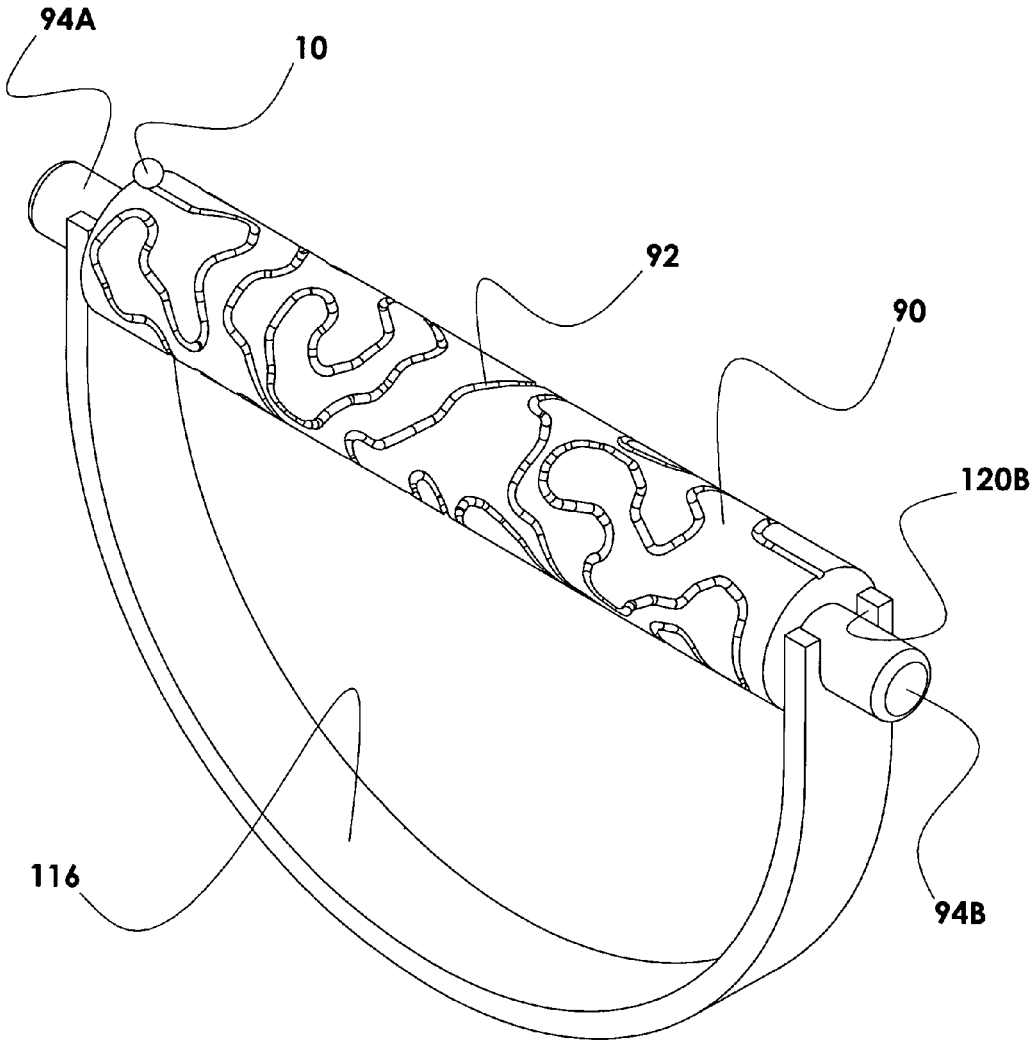

FIG. 17 shows a perspective view of additional embodiment with exploded elements FIG. 18 shows a perspective view of additional embodiment with hoop 116

| DRAWINGS - Reference Numerals | |
|---|---|
| A | Marble Clearance |
| B | Marble Clearance |
| C | Spindle Gap |
| D | Teeter Gap |
| E | Teeter Gap |
| F | Plane |
| 10 | Marble |
| 12 | Spindle |
| 14 | Groove |
| 16A | Knob |
| 16B | Knob |
| 18A | Spindle Cap |
| 18B | Spindle Cap |
| 20A | Runner |
| 20B | Runner |
| 22 | Assembly Screw |
| 24A | Retainer Bolt |
| 24B | Retainer Bolt |
| 26A | Teeter Flange |
| 26B | Teeter Flange |
| 28A | Hanger Bolt |
| 28B | Hanger Bolt |
| 30 | Marble Return |
| 32A | Teeter Plate |
| 32B | Teeter Plate |
| 34A | Spanner |
| 34B | Spanner |
| 36A | Spindle Counter Bore |
| 36B | Spindle Counter Bore |
| 38A | Spindle Bearing |
| 38B | Spindle Bearing |
| 40A | Teeter Bearing |
| 40B | Teeter Bearing |
| 42 | Pilot Hole |
| 44A | Bolt Hole |
| 44B | Bolt Hole |
| 46A | Rabbet Slope |
| 46B | Rabbet Slope |

-continued

| DRAWINGS - Reference Numerals | |
|---|---|
| 48A | Knob Counter Bore |
| 48B | Knob Counter Bore |
| 50 | Pin |
| 52 | Spline |
| 54A | Integral Knob |
| 54B | Integral Knob |
| 56A | Yoke |
| 56B | Yoke |
| 58 | Rocker |
| 60A | Knob Shoulder |
| 60B | Knob Shoulder |
| 62A | Pin Shoulder |
| 62B | Pin Shoulder |
| 64 | Teeter Box |
| 66 | Pin Box |
| 68 | Arbor |
| 70A | Arbor Shoulder |
| 70B | Arbor Shoulder |
| 72A | Dial |
| 72B | Dial |
| 74A | Slot |
| 74B | Slot |
| 76A | Bearing Slot |
| 768 | Bearing Slot |
| 78A | Arbor Cap |
| 78B | Arbor Cap |
| 80 | Fluting |
| 82 | Spin Lock |
| 84A | Teeter Pin |
| 84B | Teeter Pin |
| 86 | Arbor Box |
| 88 | Pin Relief |
| 90 | Drum |
| 92 | Furrow |
| 94A | Drum Pin |
| 94B | Drum Pin |
| 96 | Tri Bar |
| 98A | Slot |
| 98B | Slot |
| 100A | Bearing Slot |
| 100B | Bearing Slot |
| 102A | Drum Break |
| 102B | Drum Break |
| 104 | Bearing |
| 106 | Retainer Pin |
| 108 | Retainer Counter Sink |
| 110 | Planar Base |
| 112 | Dowel Pin |
| 114 | Dowel Hole |
| 116 | Hoop |
| 118A | Bearing Slot |
| 118B | Bearing Slot |
| 120A | Slot |
| 120B | Slot |

DETAILED DESCRIPTION

Figure 1:
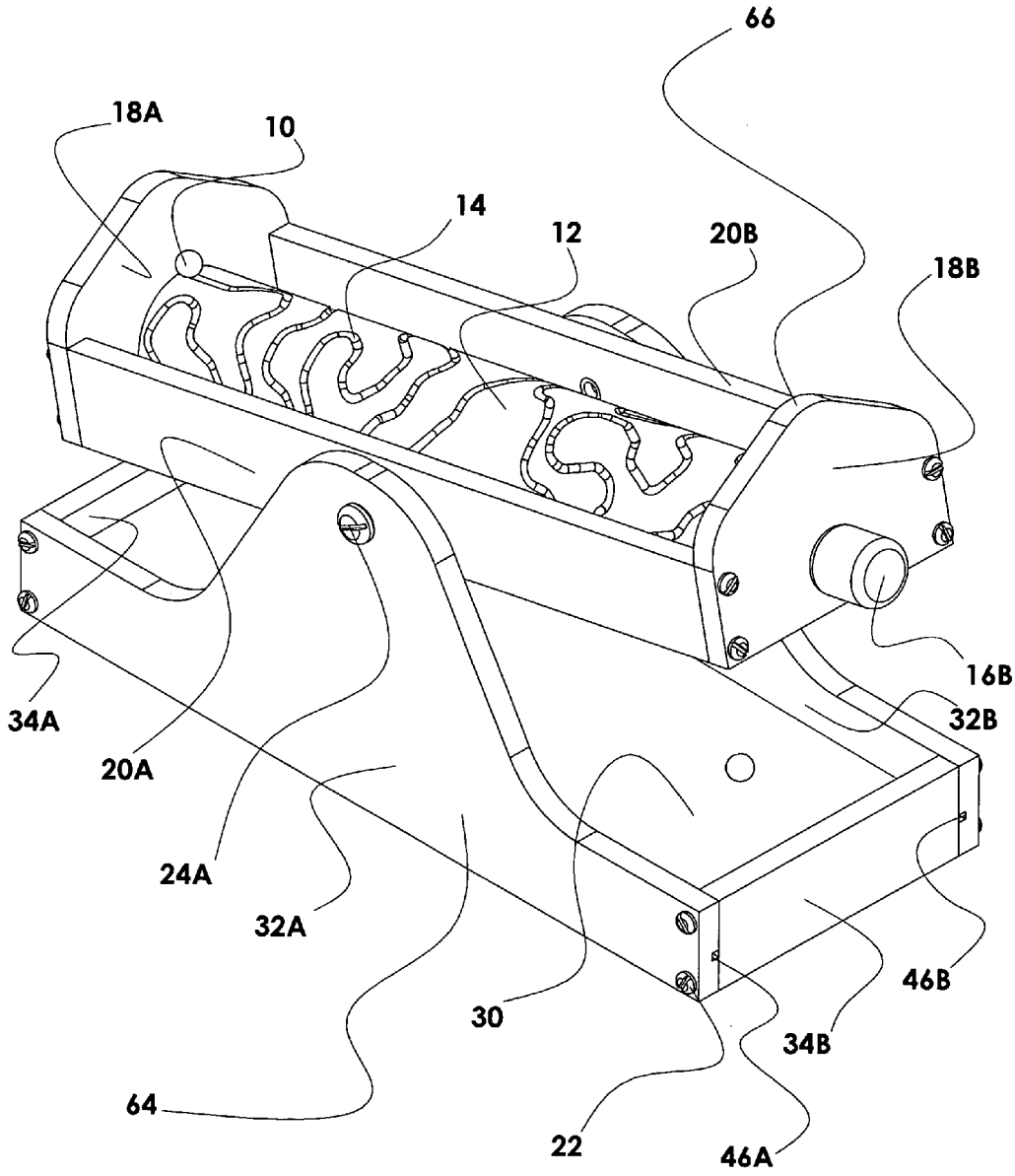
FIG. 1 shows a perspective view of the first embodiment.
Figure 2:
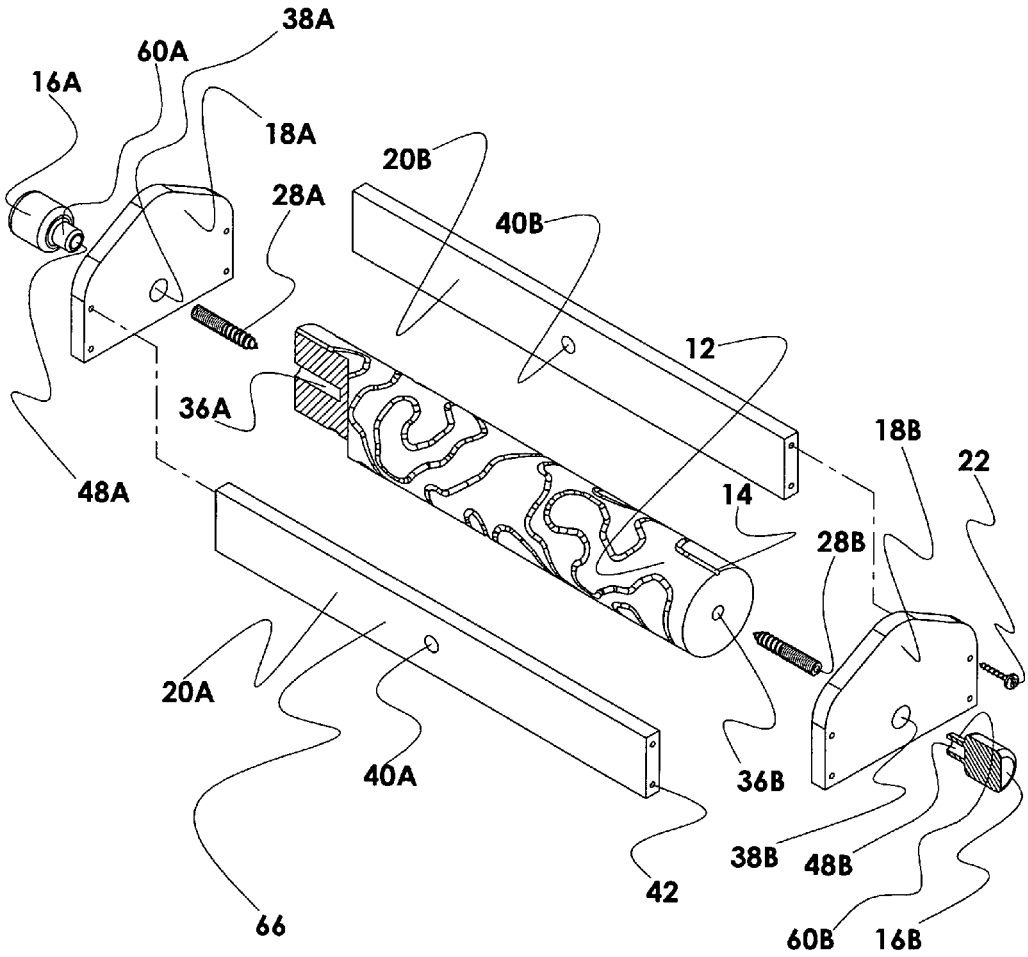
FIG. 2 shows an exploded perspective view of pin box 66

FIGS. 1, 2, 4, 5, 6, 8, 9, 10, 11, and 12—First Embodiment The first embodiment of the marble game of the present invention is illustrated in FIG. 1. It is shown that the first embodiment has two major assemblies teeter box 64 and pin box 66. The major assemblies contain subassembly parts that are preferably held together using assembly screw 22 in sufficient quantities to maintain structural integrity of the major assemblies during normal use. It should be noted that other methods to fasten teeter box 64 and pin box 66 may be used such as: glue, friction joints, nails, string, wire, and tape, Assembly of pin box 66 shown in FIG. 2 shows the various elements necessary to complete the unit (one assembly screw 22 depicted for simplicity). To begin, assembly knob 16A and hanger bolt 28A are screwed together. Knob 16A includes knob counter bore 48A that has a smooth bore that is smaller in diameter than the outside diameter of hanger bolt 28A. This will allow hanger bolt 28A to cut into the material of knob counter bore 48A to form a tight interference fit so as to prevent hanger bolt 28A from slipping or becoming loose during rotation of spindle 12 during play. Hanger bolt 28A is driven into knob counter bore 48A until it butts up against the bottom of knob counter bore 48A as shown in FIG. 11. Since hanger bolt 28A has threads at both ends preventing traditional wrenches or screwdrivers from applying torque to hanger bolt 28A to facilitate assembly, an individual with ordinary skill or owner will start hanger bolt 28A into knob counter bore 48A with their hand and then insert the unit through spindle bearing 38A. Once hanger bolt 28A is inserted through spindle bearing 38A, an owner will mate knob shoulder 60A to spindle bearing 38A and proceed to insert the exposed tip of hanger bolt 28A into spindle counter bore 36A. An owner will now apply hand pressure by holding knob 16A and spindle 12 and begin turning each in opposite directions to tighten hanger bolt 28A into both elements. Knob counter bore 48A and spindle counter bore 36A each have a depth that is sufficient in length so as the combine lengths of both counter bores will be less than the length of hanger bolt 28A in a sufficient value so that when hanger bolt 28A is fully tightened, spindle gap C (FIG. 12) will be sufficient to allow spindle 12 to rotate inside pin box 66 without any perceptible side to side shift of linear movement when pin box 66 is rocked or tilted back and forth during play. This procedure will lock spindle cap 18A concentrically between knob 16A and spindle 12. The diameter of knob shoulder 60A is smaller in diameter than spindle bearing 38A. The same procedure is applied to knob 16B, spindle cap 18B, and hanger bolt 28B driven into knob counter bore 48B and spindle counter bore 36B through spindle bearing 38B to complete the assembly of spindle 12. To finish assembly of pin box 66, runner 20A and runner 20B are attached to spindle cap 18A and spindle cap 18B by driving assembly screw(s) 22 utilizing a screwdriver through pilot hole (s) 42. Pilot hole 42 allows precise alignment of the parts without any need to measure.

Figure 4:
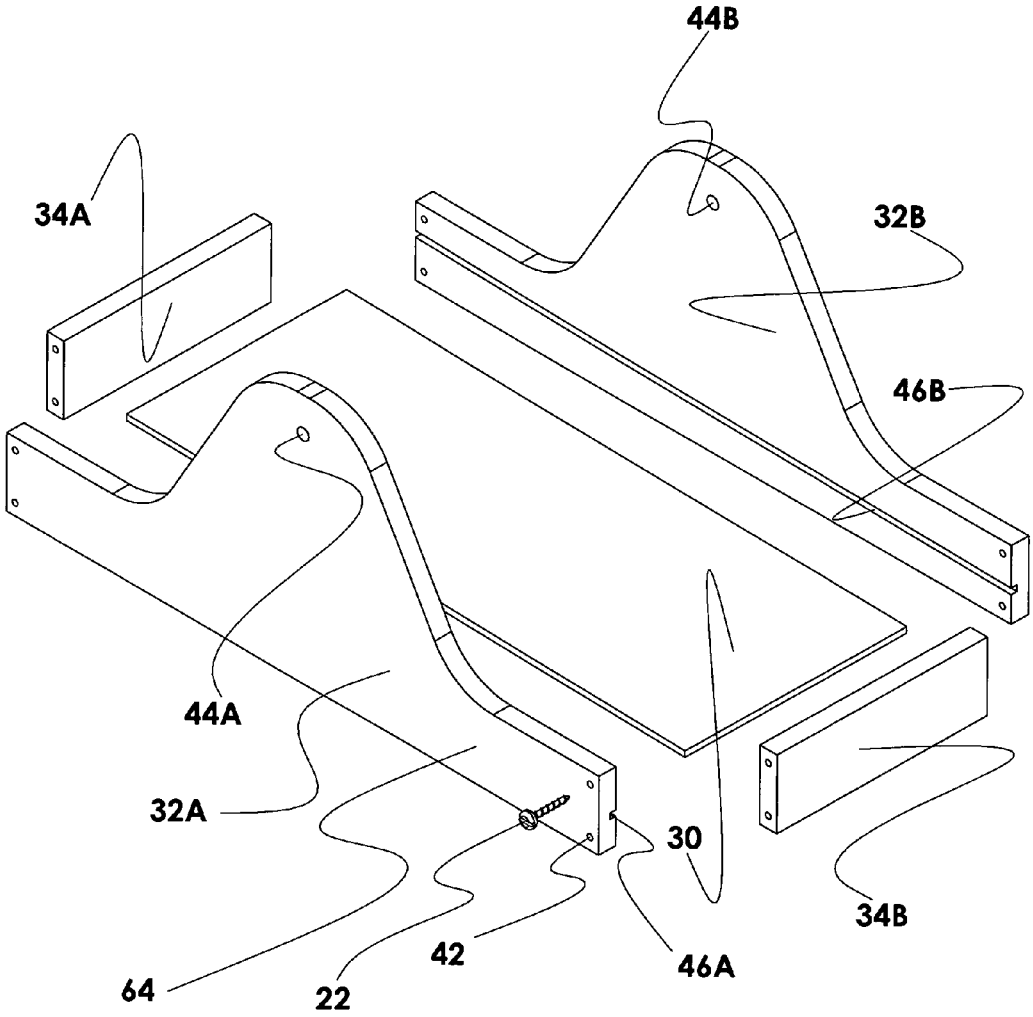
FIG. 4 shows an exploded perspective view of teeter box 64

Looking at FIG. 4, teeter box 64 forms the base of the first embodiment and is assembled as follows. Teeter plate 32B is connected to spanner 34A and spanner 34B with assembly screw (s) 22. Marble return 30 is mated to rabbet slope 46B to allow proper alignment angle of marble return 30. Teeter plate 32A with rabbet slope 46A is mated to the exposed portion of marble return 30. Assembly screw (s) 22 are driven through the exposed pilot hole (s) 42 on teeter plate 32A into the exposed pilot hole (s) 42 on spanner 34A and spanner 34B to lock all parts in place.

Moving on, FIG. 5 shows a cut away section of pin box 66 and teeter box 64 before final assembly of the first embodiment. Teeter pin 84A and teeter pin 84B are inserted into teeter bearing 40A and teeter bearing 40B. The diameter of teeter bearing 40A and 40B respectively are larger in diameter than teeter pin 84A and 848 respectively with a sufficient tolerance to allow free rotation without concentric vibration or wobble. Retainer bolt 24A and retainer bolt 2413 are screwed into bolt hole 44A and bolt hole 44B. The diameter of bolt hole 44A and bolt hole 44B are smaller in diameter than retainer bolt 24A and retainer bolt 24B with a sufficient tolerance so that the threads of the bolts will cut into the material of the bolt holes. This will allow retainer bolt 24A and 24B respectively to remain in place during positioning. Pin box 66 can now be lowered into teeter box 64 by grasping spindle 12 with one hand. Pin box 66 is lowered and positioned into teeter box 64 so that teeter pin 84A and 84B line up with retainer bolt 24A and 24B respectively. With one hand grasping spindle 12, the other hand can thread retainer bolt 24A and 2413 into teeter pin 84A and 8413 respectively. To prevent the teeter pins from spinning while tightening the bolts with a screwdriver, teeter pin 84A and 84B have at least one spin lock 82 (FIG. 10) on teeter flange 26A and 268 respectively. Spin lock 82 will bite into the material of teeter plate 32A and 32B respectively when retainer bolts 24A and 24B are secured and will prevent the teeter pins from spinning and become loose during play. Teeter flange 26A and 26B form teeter gap D and teeter gap E as shown in FIG. 6 and FIG. 9. Teeter flange 26A and 26B precisely center pin box 66 between teeter plate 32A and teeter place 32B. This allows pin box 66 to tilt back and forth without interference. Looking at FIG. 8 pin box 66 may be precisely balanced and if necessary a counter weight may be added to either end of pin box 66 so that is will rest level. The axis of spindle 12 is centered through the axis of teeter bearing 26A and teeter bearing 26B as well as retainer bolt 24A and retainer bolt 24B as shown by plane F (FIGS. 8 and 9).

The materials and methods used to manufacture the parts for this invention can vary from any suitable rigid materials such as: wood species, plastic formulations, metals, metal alloys, and glass formulations. The various parts can be milled using cutting tools or molding techniques or casting techniques. The irregular curve geometry or meandering groove 14 can be milled tangent around the surface of spindle 12 concentric to the axis of spindle 12 by controlling the roll rate of spindle 12 and the linear movement rate of a milling machine or router that runs parallel to the axis of spindle 12 with its cutting bit or router bit perpendicular to the axis of spindle 12 by precisely combining or isolating the movement rates of both variables. Engineering techniques can be employed to reduce weight and increase strength of parts.

Looking at FIG. 12 marble 10 is resting on top of groove 14. As can be seen where marble 10 rest, groove 14 is concave. The depth and width of groove 14 is a determining factor in the amount of skill a player must possess or acquire to play the toy. Thus, greater depth and wider grooves decrease skill necessary to play the toy. Additionally, the radii values of the meandering curves of groove 14 also determine the skill necessary to play the toy.

DETAILED OPERATION

FIGS. 1, 6, 7, and 9—First Embodiment

To play the game, the first embodiment in FIG. 1 is set on top of a surface. It is preferred that the surface be a level planar surface such as a table. It is preferred that the player be seated in a chair and be as relaxed and as comfortable as possible during play. To begin play (FIG. 7), marble 10 is removed from marble return 30 and placed on top of spindle 12 at groove 14 with pin box 66 tilted to one side so marble 10 can rest in groove 14 and rest tangent to spindle cap 18A. If necessary spindle 12 is rotated so that the starting point of groove 14 is approximately top dead center so marble 10 does not roll off groove 14 prematurely (FIG. 6). A player is to grasp knob 16A and knob 16B in each hand. Knob 16A and knob 16B function as dials to control the roll of spindle 12 and act as handles to change the pitch of pin box 66. To negotiate the curves of groove 14, a player must combine the roll and pitch precisely to keep marble 10 on groove 14. When control is lost, marble 10 will fall of spindle 12 and pass between either marble clearance A or marble clearance B (FIGS. 6 and 9). As seen in FIG. 7, once marble 10 falls of spindle 12 it will land on marble return 30 and roll towards the lowest side for consistent landing stop of marble 10 for easy retrieval by players for the next round of play. By tilting pin box 66 to one side a player can reach into the area of teeter box 64 to grab marble 10.

Figure 3:
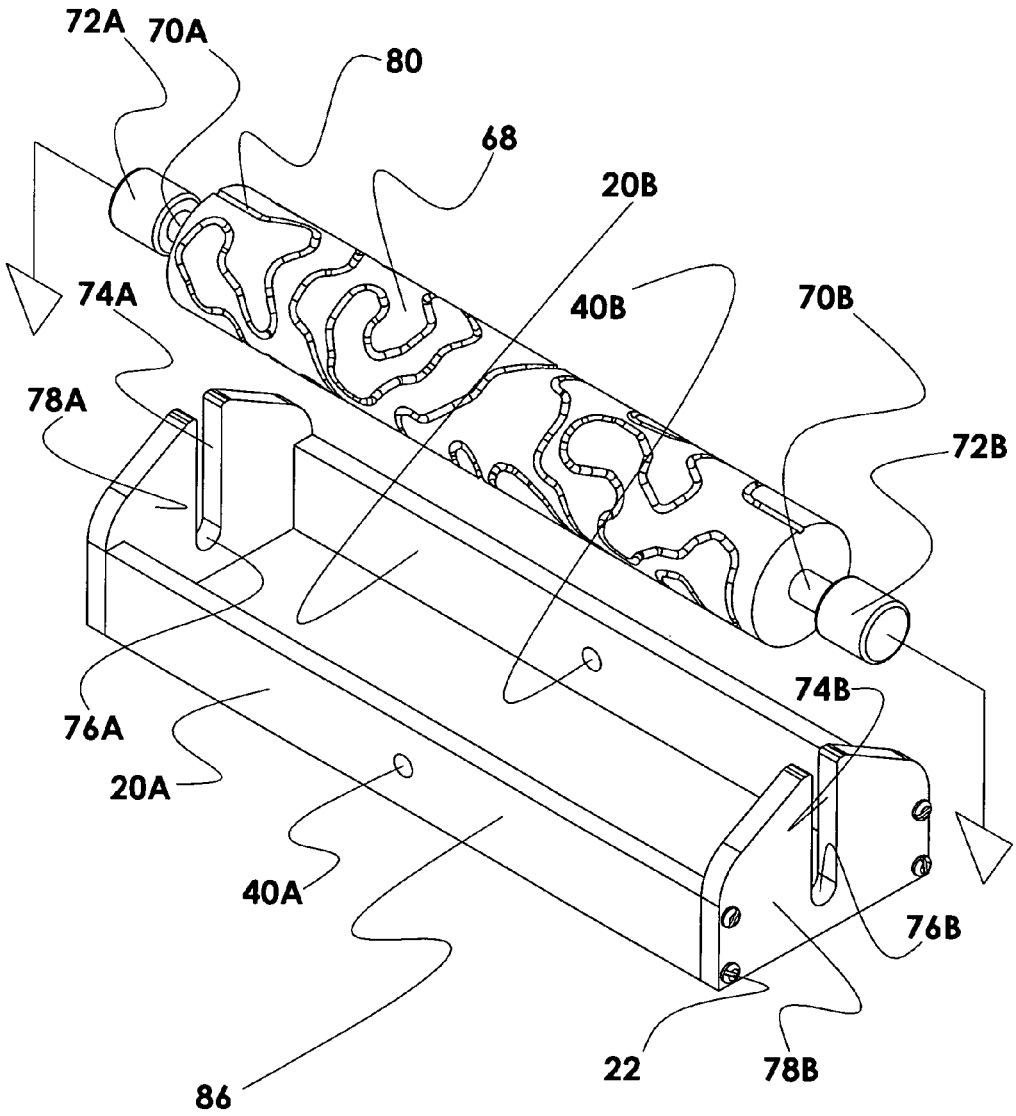
FIG. 3 shows a perspective view of a modified embodiment arbor box 86 with arbor 68

FIGS. 3, 13, and 14—Alternate Embodiments

An alternate embodiment to replace pin box 66 is shown in FIG. 3 as arbor box 86. This embodiment reduces the number of parts to complete a working unit. Specifically, spindle 12 (first embodiment) has been replaced by arbor 68 and spindle cap 18A and 18B have been replaced by arbor cap 78A and 78B. Arbor 68 is an integral unit with no moving parts. Arbor shoulder 70A and 70B protrudes from each end of arbor 68. The length of the arbor shoulder 70A is greater than the width of slot 74A of a sufficient value as to allow arbor 68 to spin freely inside arbor box 86 without any perceptible side to side shift of linear movement during play. The same parameters apply to arbor shoulder 70B and slot 74B. Dial 72A and dial 72B are sufficient in diameter so that the average hand size of a population can grasp them comfortably. Arbor 68 is larger in diameter than the width of slot 74A and 74B so as to lock arbor 68 inside arbor box 86 preventing derailing of arbor 68 during play. Bearing slot 76A and bearing slot 76B are semi annular to provide an efficient surface for mating to arbor shoulders 70A and 70B respectively. Bearing slots 76A and 768 are larger in diameter than arbor shoulders 70A and 70B in sufficient tolerance to allow rotation without concentric vibration or wobble. Runner 20A and runner 20B are connected to arbor cap 78A and arbor cap 78B utilizing assembly screw (s) 22 to form arbor box 86. Arbor box 86 is assembled to teeter box 64 in the same manner as pin box 66 with the exception that arbor 68 is mated to bearing slots 76A and 7613 after assembly.

The materials and methods used to manufacture the parts for this invention can vary from any suitable rigid materials such as: wood species, plastic formulations, metals, metal alloys, and glass formulations. The various parts can be milled using cutting tools or molding techniques or casting techniques. The irregular curve geometry or meandering fluting 80 can be milled tangent around the surface of arbor 68 concentric to the axis of arbor 68 by controlling the roll rate of arbor 68 and the linear movement rate of a milling machine or router that runs parallel to the axis of arbor 68 with its cutting bit or router bit perpendicular to the axis of arbor 68 by precisely combining or isolating the movement rates of both variables. Engineering techniques can be employed to reduce weight and increase strength of parts.

Looking at FIGS. 13 and 14 show an alternate embodiment where teeter box 64 has been replaces with rocker 58 and spindle 12 is replaced with pin 50. Pin 50 is an integral unit with no moving parts similar to arbor 68. Integral knob 54A and 54B are sufficient in diameter so that the average hand size of a population can grasp them comfortably. Pin shoulder 62A and 62B are smaller in diameter than the width of rocker 58 so that yoke 56A and 56B can be centered widthwise into the top of rocker 58. Yoke 56A and 56B have an annular bottom portion that will mate efficiently to the diameter of pin shoulder 62A and 62B. The diameter of yoke 56A and 56B has a greater value than the diameter of pin shoulder 62A and 62B with sufficient tolerance to allow free spinning of pin 50 while turning integral knob 54A and 54B during play without excess vibration or wobble concentrically. At the top of rocker 58 is pin relief 88 that allows for clearance of pin 50 to spin freely during play. Spline 52 is similar to groove 14.

The materials and methods used to manufacture the parts for this invention can vary from any suitable rigid materials such as: wood species, plastic formulations, metals, metal alloys, and glass formulations. The various parts can be milled using cutting tools or molding techniques or casting techniques. The irregular curve geometry or meandering spline 52 can be milled tangent around the surface of pin 50 concentric to the axis of pin 50 by controlling the roll rate of pin 50 and the linear movement rate of a milling machine or router that runs parallel to the axis of pin 50 with its cutting bit or router bit perpendicular to the axis of pin 50 by precisely combining or isolating the movement rates of both variables. Engineering techniques can be employed to reduce weight and increase strength of parts.

FIGS. 3, 13, and 14—Alternate Embodiments

To play the game using arbor box 86 instead of pin box 66 is exactly the same as described in the first embodiment with the exception that arbor 68 is not permanently fixed to arbor box 86. This requires a player to set arbor 68 into slots 74A and 74B before play.

To play the alternate embodiment shown in FIGS. 13 and 14 requires a player to hold rocker 58 upright on a planar surface and insert pin 50 into yoke 56A and 56B before play. After rocker 58 and pin 50 are combined a player will use one hand to hold the assembly and grasp marble 10 with their free hand. Marble 10 is placed at the starting point of spline 52. Once marble 10 is released a player needs to immediately begin to play the game by combining the roll of pin 50 with the rocking motion of rocker 58 to negotiate the curves of spline 52. A player will grasp integral knobs 54A and 54B to rotate pin 50 and roll rocker 58 on a planar surface. It is not necessary to have a marble catch to recover the marble when a player loses control, but additional modifications can be designed to include a marble catcher. For example, the planar surface could have speed bumps made by rolling cotton cloth lain on the planar surface (not shown) to stop marble 10 from rolling off the planar surface.

FIGS. 15, 16, 17, and 18—Additional Embodiments

Looking at FIGS. 15 and 16 shows an additional embodiment. Planar base 110 is a single part with dowel hole 114 that is centered lengthwise to planar base 110. Planar base 110 has a flat bottom portion to mate to a flat planar surface such as a table during play. Planar surface or tri bar 96 is a single part with at least two terminal ends or drum break 102A and 102B that are perpendicular to the length of tri bar 96. Drum break 102A and 102B have a defined open portion or slot 98A and 9813 that have a round bottom portion or bearing slot 100A and 100B that mate to a reduced integral cylindrical portion or drum pin 94A and 94B that are centered to the concentric axis of drum 90. The diameter of drum pin 94A and 94B is smaller than the diameter of bearing slot 100A and 100B with a sufficient tolerance value so that drum 90 will spin freely without concentric wobble and vibration during play. The length of drum 90 minus the combined lengths of drum pin 94A and 94B is less than the inside linear distance measuring between the inside planes of drum break 102A and 102B with a sufficient tolerance value so that drum 90 will have an imperceptible side to side shift during play without restricting rotation of drum 90. Tri bar 96 has concentric hole or bearing 104 with a flared tapered end that mates to a increased integral portion or retainer counter sink 108 of retainer pin 106. Bearing 104 is centered lengthwise and height wise of tri bar 96. Tri bar 96 is connected to planar base 110 through retainer pin 106. Dowel 112 has a diameter that is smaller than the diameter of concentric hole or dowel hole 114 with a sufficient value to allow the proper bonding of adhesive or larger diameter for friction interference press fit to lock tri bar 96 to planar base 110. Tri bar 96 is connected to planar base 110 so that tri bar 96 can teeter on the surface of bearing 104. Retainer counter sink 108 locks tri bar 96 to planar base 110 with positive interference or wedge. Furrow 92 meanders around the surface of drum 90.

The materials and methods used to manufacture the parts for this invention can vary from any suitable rigid materials such as: wood species, plastic formulations, metals, metal alloys, and glass formulations. The various parts can be milled using cutting tools or molding techniques or casting techniques. The irregular curve geometry or meandering furrow 92 can be milled tangent around the surface of drum 90 concentric to the axis of drum 90 by controlling the roll rate of drum 90 and the linear movement rate of a milling machine or router that runs parallel to the axis of drum 90 with its cutting bit or router bit perpendicular to the axis of drum 90 by precisely combining or isolating the movement rates of both variables. Engineering techniques can be employed to reduce weight and increase strength of parts.

Moving on to FIGS. 17 and 18 shows an additional embodiment with a semi annular surface or hoop 116 with at least two terminal ends with a defined open portion or slot 120A and 120B with a defined annular bottom portion or bearing slot 118A and 118B. Drum pin 94A and 94B mate to slot 120A and 120B and rest in bearing slot 118A and 118B as indicated by arrow in FIG. 17. The diameter of drum pin 94A and 94B is smaller than the diameter of bearing slot 118A and 118B with a sufficient tolerance value so that drum 90 will spin freely without concentric wobble and vibration during play. The length of drum 90 is less than the inside space between the terminal ends of hoop 116 with a sufficient tolerance value so that drum 90 will have an imperceptible side to side shift during play without restricting rotation of drum 90.

FIGS. 15, 16, 17, and 18—Additional Embodiments

To play the additional embodiment shown in FIGS. 15 and 16 requires a player to place planar base 110 on a planar surface and insert drum pin 94A and 94B into slot 98A and 98B before play. After tri bar 96 and drum 90 are combined a player will use one hand to hold the assembly and grasp marble 10 with their free hand. Marble 10 is placed at the starting point of furrow 92. Once marble 10 is released a player needs to immediately begin to play the game by combining the roll of drum 90 with the teeter motion of tri bar 96 to negotiate the curves of furrow 92. A player will gasp drum pin 94A and 94B to rotate drum 90 and teeter tri bar 96 concentrically on retainer pin 106. It is not necessary to have a marble catch to recover the marble when a player loses control, but additional modifications can be designed to include a marble catcher. For example, the planar surface could have speed bumps made by a rolled cotton cloth lain on the planar surface (not shown) to stop marble 10 from rolling off the planar surface.

To play the additional embodiment shown in FIGS. 17 and 18 requires a player to hold hoop 116 upright on a planar surface and insert drum pin 94A and 94B into slot 120A and 120B before play. After hoop 116 and drum 90 are combined a player will use one hand to hold the assembly and grasp marble 10 with their free hand. Marble 10 is placed at the starting point of furrow 92. Once marble 10 is released a player needs to immediately begin to play the game by combining the roll of drum 90 with the rocking motion of hoop 116 to negotiate the curves of furrow 92. A player will grasp drum pin 94A and 94B to rotate drum 90 and roll hoop 116 on a planar surface. It is not necessary to have a marble catch to recover the marble when a player loses control, but additional modifications can be designed to include a marble catcher. For example, the planar surface could have speed bumps made by rolling cotton cloth lain on the planar surface (not shown) to stop marble 10 from rolling off the planar surface.

It permits flexibility of suppliers relied upon to manufacture the produce, ensures that competitive pricing is available, and provides insurance against shortages and price increases, and provides flexibility in materials used to manufacture.

It permits accelerated market acceptance through product originality, provides hours of entertainment by its unique aesthetic looks, and increase sales attraction by consumer's curiosity to the novelty of something new and fun to play.

It permits fulfillment to a wide range of individuals that may have physical handicaps or impediments to hand-eye coordination such as stroke victims, reduces stress tension by providing satisfying entertaining experiences that improves one's health and outlook on life, and offers a wonderful pastime for acquiring and applying manual dexterity skills.

Although the description above contains much specificity, this should not be construed as limiting the scope of the invention but as merely providing illustrations of some of the presently preferred embodiments of this invention. For example, spindle 12 could be other shapes beside a cylindrical such as triangular or spherical, drum pin 94A and 94B can be other shapes such as octagon, bearing slots 100A and 100B that receive drum pin 94A and 94B can be other shapes besides annular such as flat or angular, retainer pin 106 can have a flange instead of a wedge counter sink to lock tri bar 96 to planar base 110, groove 14 can have a flat defined planar bottom portion, a stand could be added so individuals could play standing up in a store setting, transparent plastic could be used and illuminated with artificial light so as to play the game in low light level, electronic sound effects could be added when the marble falls into the catcher, to include a numbering system on the playing surface that indexes each curve with a number or letter to remind players how far through the maze they have achieved, and the base could include a rotational device to spin the embodiment around parallel to the planar surface so as to face different players sitting around a table setting.

I claim:

1. A non planar surface with a concentric axis with a tangent groove meandering around the surface area of said non planar surface with a reduced integral portion at each end of said non planar surface concentric to said concentric axis with said reduced integral portions mated to a defined open portion of at least two terminal ends of a semi annular surface whereby said non planar surface with said reduced integral portions can spin inside said defined open portion of said terminal ends.

2. The device of claim 1 wherein said non planar surface can be composed of a material selected from the group consisting of rigid materials, wood species, plastic formulations, metals, metal alloys, and glass formulations.

3. The device of claim 1 wherein said semi annular surface can be composed of a material selected from the group consisting of rigid materials, wood species, plastic formulations, metals, and metal alloys.

4. The device of claim 1 wherein said non planar surface is cylindrical.

5. The device of claim 1 wherein said defined open portion at said terminal ends are round at the bottom.

6. The device of claim 1 wherein said groove is concave.

7. The device of claim 1 wherein said reduced integral portions are cylindrical.

8. A non planar surface with a concentric axis with a tangent groove meandering around the surface area of said non planar surface with a reduced integral portion at each end of said non planar surface concentric to said concentric axis with said reduced integral portions mated to a defined open portion of at least two terminal ends perpendicular to the length of a planar surface with a concentric bearing surface through said planar surface centered between said terminal ends connected to a planar base with a pin through said concentric bearing surface with said pin fastened to a concentric hole through said planar base with a increased integral portion at one end of said pin connected to said concentric bearing surface of said planar surface whereby said concentric bearing surface can ride on said pin and said planar surface can pitch up and down.

9. The device of claim 8 wherein said semi annular surface can be composed of a material selected from the group consisting of rigid materials, wood species, plastic formulations, metals, and metal alloys.

10. The device of claim 8 wherein said semi annular surface can be composed of a material selected from the group consisting of rigid materials, wood species, plastic formulations, metals, and metal alloys.

11. The device of claim 8 wherein said planar base can be composed of a material selected from the group consisting of rigid materials, wood species, plastic formulations, metals, and metal alloys.

12. The device of claim 8 wherein said non planar surface is cylindrical.

13. The device of claim 8 wherein said groove is concave.

14. The device of claim 8 wherein said reduced integral portions are cylindrical.

15. The device of claim 8 wherein said defined open portion at said terminal end are round at the bottom.

16. The device of claim 8 wherein said concentric hole through said planar base is centered lengthwise to said planar base.

17. The device of claim 8 wherein said pin is frictionally fastened to said concentric hole through said planar base.

* * * * *